US007265738B2

(12) United States Patent
Kawashima et al.

(10) Patent No.: US 7,265,738 B2
(45) Date of Patent: Sep. 4, 2007

(54) METHOD AND APPARATUS FOR DRIVING ELECTRO-LUMINESCENCE DISPLAY PANEL DESIGNED TO PERFORM EFFICIENT BOOTING

(75) Inventors: Shingo Kawashima, Kanagawa-ken (JP); Shuji Yamaguchi, Kanagawa-ken (JP)

(73) Assignee: Samsung SDI Co., Ltd., Suwon (KR)

( * ) Notice: Subject to any disclaimer, the term of this patent is extended or adjusted under 35 U.S.C. 154(b) by 582 days.

(21) Appl. No.: 10/823,722

(22) Filed: Apr. 14, 2004

(65) Prior Publication Data

US 2004/0257313 A1 Dec. 23, 2004

(30) Foreign Application Priority Data

Apr. 15, 2003 (KR) ..... 10-2003-0023713

(51) Int. Cl.
*G09G 3/30* (2006.01)

(52) U.S. Cl. ..... 345/76; 345/82; 315/169.1; 315/169.3

(58) Field of Classification Search ..... 345/60–100, 345/204; 315/169.1–169.4
See application file for complete search history.

(56) References Cited

U.S. PATENT DOCUMENTS

| | | | | |
|---|---|---|---|---|
| 6,369,516 | B1 * | 4/2002 | Iketsu et al. | 345/76 |
| 6,847,342 | B2 * | 1/2005 | Tsuji | 345/82 |
| 7,113,156 | B2 * | 9/2006 | Hashimoto | 345/77 |
| 2002/0024481 | A1 * | 2/2002 | Kawabe et al. | 345/87 |

* cited by examiner

*Primary Examiner*—David L. Lewis
(74) *Attorney, Agent, or Firm*—H.C. Park & Associates, PLC

(57) ABSTRACT

Provided are a method and apparatus for driving an electro-luminescence (EL) display panel having data electrode lines and scanning electrode lines intersecting each other at a predetermined distance and EL cells, formed at the intersections thereof. In the method and apparatus, a booting current corresponding to a magnitude change of a display data signal in the next horizontal drive time period with respect to a display data signal in the current horizontal drive time period is applied to each of the data electrode lines at the beginning of the next horizontal drive time period. Instantaneous values of the booting currents are kept constant, and the application time for the booting current is proportional to a magnitude change of each display data signal in the next horizontal drive time period with respect to the display data signal in the current horizontal drive time period.

8 Claims, 6 Drawing Sheets

METHOD AND APPARATUS FOR DRIVING ELECTRO-LUMINESCENCE DISPLAY PANEL DESIGNED TO PERFORM EFFICIENT BOOTING

CROSS REFERENCE TO RELATED APPLICATION

This application claims the priority of Korean Patent Application No. 2003-23713, filed on Apr. 15, 2003, in the Korean Intellectual Property Office, the disclosure of which is incorporated herein by reference in its entirety.

FIELD OF THE INVENTION

The present invention relates to a method and apparatus for driving an electro-luminescence (EL) display panel, and more particularly, to a method and apparatus for driving an EL display panel having electro-luminescence cells formed at intersections between data and scanning electrode lines crossing each other at a predetermined distance.

BACKGROUND OF THE INVENTION

Referring to FIG. 1, a conventional EL display device includes an EL display panel 2 and a driving circuit. The driving circuit comprises a controller 21, a scanning driving unit 6, and a data driving unit 5. The EL display panel 2 has a plurality of data electrode lines 3 and scanning electrode lines 4 intersecting each other at a predetermined distance. The EL display panel 2 further has electro-luminescence cells 1, each being formed at the intersections between the data electrode lines 3 and the scanning electrode lines 4.

The controller 21 receives and processes image signals $S_{IM}$. The processing includes applying data control signals $S_{DA}$ and scanning control signals $S_{SC}$ to the data driving unit 5 and the scanning driving unit 6, respectively. The data control signals $S_{DA}$ include the display data signals and the switching control signals, while the scanning control signals $S_{SC}$ are the switching control signals.

The data driving unit 5 connected to the signal-input terminals of the data electrode lines 3 produces data current signals, corresponding to the display data signals from the controller 21 in response to the switching control signals received from the controller 21, and applies the data current signals to the data electrode lines 3. Here, reference number 8 denotes current sources.

The scanning driving unit 6 connected to the signal-input terminals of the scanning electrode lines 4 sequentially applies scanning driving signals, in response to the switching control signals received from the controller 21, to the scanning electrode lines 4.

Referring to FIG. 1 and FIG. 2, the data driving unit 5 of the EL display device of FIG. 1 includes an interface 30, a latch circuit 31, digital-to-analog (D/A) converters 32, and an output circuit 33.

The latch circuit 31, operating according to a horizontal synchronization signal $H_{SYNC}$ received from the controller 21 through the interface 30, periodically stores the display data signals $D_{DA}$ received from the controller 21 through the interface 30 while periodically outputting display data signals in the current and next horizontal drive time periods, respectively. Each of the D/A converters 32 converts each of the display data signals in the current horizontal drive time period received from the latch circuit 31 into a data current signal. The output circuit 33 then applies data output signals $I_{D1}$-$I_{Dm}$, corresponding to the display data signals received from the D/A converters 32, to the corresponding data electrode lines 3, respectively.

As an example of a conventional EL display device configured as above, U.S. Pat. No. 6,531,827 discloses a technology for improving driving speed by applying booting current at the beginning of each horizontal drive time period. European Laid-open Patent Publication No. 1,091,340 proposes a technology for reducing power consumption by controlling the booting current according to a change in the amount of data. A conventional driving apparatus and method using the above-cited technologies will now be described.

Referring to FIGS. 1, 2 and 3, the latch circuit 31 of the data driving unit 5 of FIG. 2 generally comprises (n+1)-data registers $\mathbf{31}_{R1}$-$\mathbf{31}_{Rm}$ and n-data latches $\mathbf{31}_{L1}$-$\mathbf{31}_{Lm}$. The output circuit 33 of the data driving unit 5 includes digital comparators $\mathbf{33}_{C1}$-$\mathbf{33}_{Cm}$, D/A converters $\mathbf{33}_{D1}$-$\mathbf{33}_{Dm}$, and output current switches $S_1$-$S_m$.

Each of the (n+1)-data registers $\mathbf{31}_{R1}$-$\mathbf{31}_{Rm}$ outputs a display data signal stored therein according to the horizontal synchronization signal $H_{SYNC}$ and stores a display data signal $D_{n+1}$ received from the controller 21 through the interface 30. The n-data latches $\mathbf{31}_{L1}$-$\mathbf{31}_{Lm}$ output display data signals stored therein in response to the horizontal synchronization signal $H_{SYNC}$ and store the display data signals $D_n$ received from the (n+1)-data registers $\mathbf{31}^{R1}$-$\mathbf{31}_{Rm}$, respectively. The D/A converters $\mathbf{32}_1$-$\mathbf{32}_m$ then convert the display data signals $D_n$ in the current horizontal drive time period received from the n-data latches $\mathbf{31}_{L1}$-$\mathbf{31}_{Lm}$ into data current signals $I_{DP1}$-$I_{DPm}$, respectively.

The digital comparators $\mathbf{33}_{C1}$-$\mathbf{33}_{Cm}$ of the output circuit 33 compare the display data signals $D_n$ in the current horizontal drive time period received from n-data latches $\mathbf{31}_{L1\text{-}31Lm}$ with the display data signals $D_{n+1}$ in the next horizontal drive time period received from (n+1)-data registers $\mathbf{31}_{R1}$-$\mathbf{31}_{Rm}$, respectively. The digital comparators $\mathbf{33}_{C1}$-$\mathbf{33}_{Cm}$ generate booting data signals according to the comparison results. The D/A converters $\mathbf{33}_{D1}$-$\mathbf{33}_{Dm}$ convert the booting data signals received from the digital comparators $\mathbf{33}_{C1}$-$\mathbf{33}_{Cm}$ into analog signals and output booting current signals $I_{B1}$-$I_{Bm}$, respectively. The output current switches $S_1$-$S_m$ apply data output signals $I_{D1}$-$I_{Dm}$ to the data electrode lines 3, respectively. The data output signals $I_{D1}$-$I_{Dm}$ are generated by alternately selecting the output signals $I_{B1}$-$I_{Bm}$ of the D/A converters $\mathbf{33}_{D1\text{-}33Dm}$ of the output circuit 33 or output signals $I_{DP1}$-$I_{DPm}$ of the D/A converters $\mathbf{32}_1$-$\mathbf{32}_m$, respectively.

A method for driving a conventional EL display device having a data driving unit 5 as shown in FIG. 3 will now be described with reference to FIGS. 3 and 4. In FIG. 4, reference character $I_{DP1}$ is a data current signal from D/A converter $\mathbf{32}_1$, $I_{D1}$ is a data output signal applied to the data electrode line (3*a* of FIG. 1) from the output current switch $S_1$ corresponding to the D/A converter $\mathbf{32}_1$, $V_{D1}$ is a data voltage signal applied to the data electrode line 3*a*, and $V_{S1}$-$V_{S6}$ are scanning voltage signals applied to the scanning electrode lines (4 of FIG. 1).

With reference to the data output signal $I_{D1}$, a booting current corresponds to a magnitude change of a display data signal $D_{n+1}$ in a next horizontal drive time period with respect to a display data signal $D_n$ in a current horizontal drive time period. The booting current is applied to the data electrode line 3*a* at the beginning of the next horizontal drive time period. An instantaneous value of the booting current is proportional to a magnitude change of the data current signal $I_{DP1}$. In connection therewith, first and second drive periods t1~t3 and t3~t5 will now be representatively described.

The magnitude of the data current signal IDPI at the scanning time interval t2~t3 increases over that of the data current signal $I_{DP1}$ at the previous scanning time interval (not shown) during booting time interval t1~t2 of the first horizontal drive period t1~t3. A positive polarity booting current, proportional to the amount by which the magnitude of the data current signal $I_{DP1}$ at the scanning time interval t2~t3 increases from the previous scanning time interval, is applied to the data electrode line 3*a*.

Conversely, the magnitude of the data current signal $I_{DP1}$ at scanning time interval t4~t5 decreases over that of the data current signal $I_{DP1}$ at the previous scanning time interval t2~t3 during booting time interval t3~t4 of the second horizontal drive period t3~t5. A negative polarity booting current, proportional to the amount by which the magnitude of the data current signal $I_{DP1}$ at the scanning time interval t4~t5 decreases from the previous scanning time interval t2~t3, is applied to the data electrode line 3*a*.

Thus, the typical driving apparatus and method can improve the driving speed using the booting current. However, since the instantaneous value of booting current are proportional to the magnitude change of the data current signal $I_{DP1}$, the instantaneous value of booting current may increase significantly when the change becomes very large. This may cause crosstalk such that EL cells that are not scanned glow, as well as increase power consumption.

SUMMARY OF THE INVENTION

The present invention provides a method and apparatus for driving an electro-luminescence (EL) display panel designed to prevent occurrences of crosstalk, that is, when EL cells not scanned emit light, and reduce power dissipation, by efficiently applying a booting current for high speed operation at the beginning of a horizontal drive period.

According to an aspect of the present invention, there are provided a method and apparatus for driving an electro-luminescence (EL) display panel having data electrode lines and scanning electrode lines intersecting each other at a predetermined distance and EL cells, where each EL cell is formed at the intersections thereof. In the method and apparatus, a booting current, corresponding to a magnitude change of a display data signal in the next horizontal drive time period with respect to a display data signal in the current horizontal drive time period, is applied to each of the data electrode lines at the beginning of the next horizontal drive time period. Instantaneous values of the booting currents are kept constant, and the application time for the booting current is proportional to a magnitude change of each display data signal in the next horizontal drive time period with respect to the display data signal in the current horizontal drive time period.

The method and apparatus for driving the EL display panel make the instantaneous values of the booting currents constant by adjusting the power required for the booting currents according to the application time. Thus, since it is possible to limit excessive increases in instantaneous values of the booting currents, this invention may prevent occurrences of crosstalk caused by unscanned EL cells emitting light, while reducing power consumption.

BRIEF DESCRIPTION OF THE DRAWINGS

The above and other features and advantages of the present invention will become more apparent by describing in detail exemplary embodiments thereof with reference to the attached drawings.

DETAILED DESCRIPTION OF THE INVENTION

Since the basic configuration and operation of the conventional driving circuit described earlier with reference to FIGS. 1 and 2 also apply to a driving apparatus of this invention, a detailed description thereof will not be given.

Figure 1:
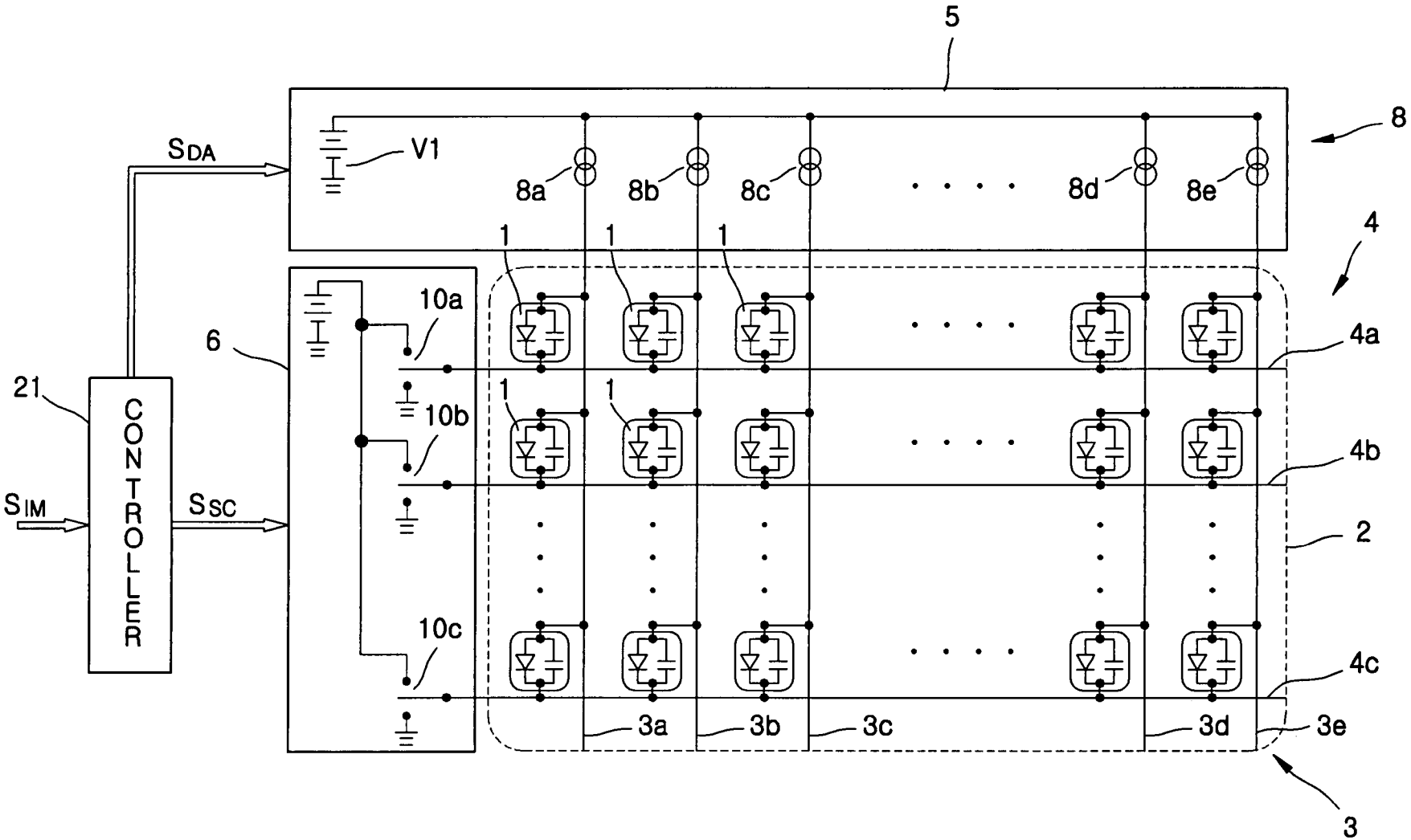
FIG. 1 (PRIOR ART)
FIG. 1 shows the configuration of a conventional electro-luminescence (EL) display device.
Figure 2:
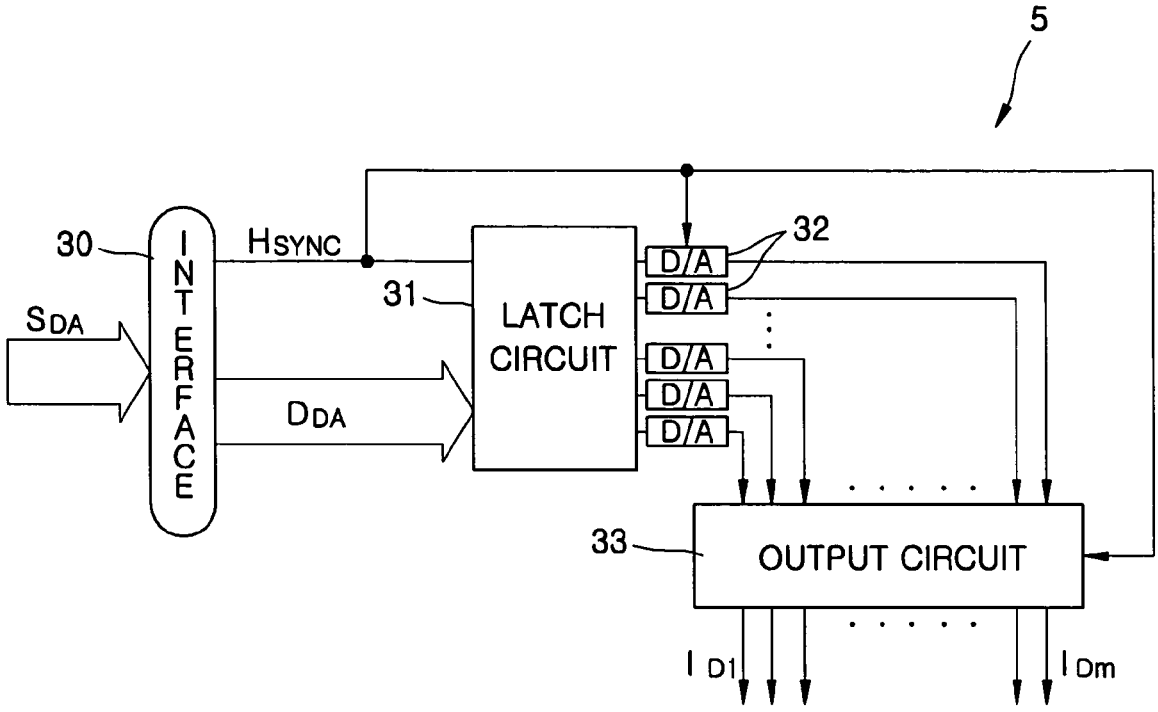
FIG. 2 (PRIOR ART)
FIG. 2 is a block diagram showing the configuration of the data driving unit shown in FIG. 1.
Figure 3:
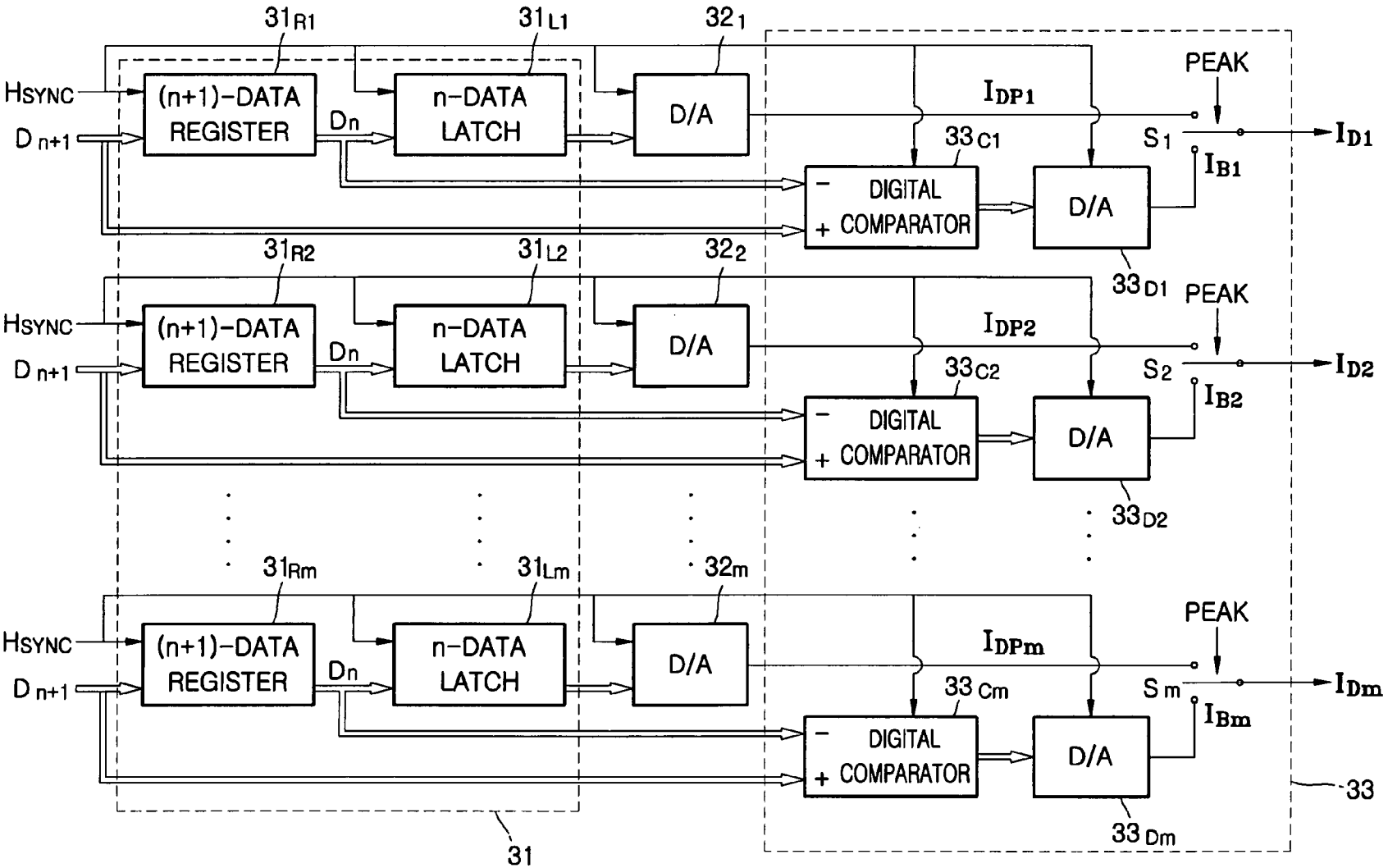
FIG. 3 (PRIOR ART)
FIG. 3 is a detailed block diagram showing a conventional interior configuration of the data driving unit of FIG. 2.
Figure 4:
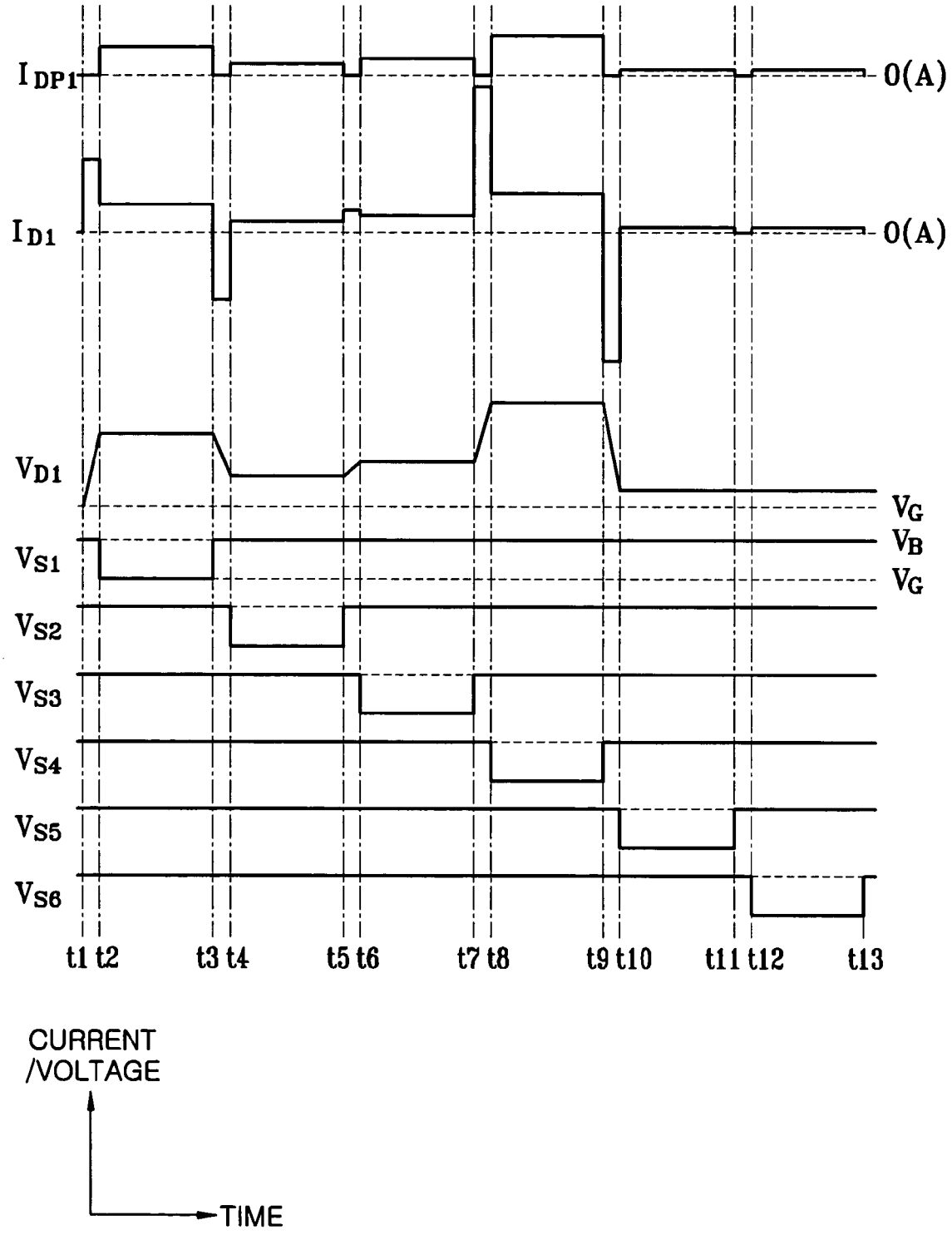
FIG. 4 (PRIOR ART)
FIG. 4 is a timing diagram for explaining a method for driving a conventional EL display device having the data driving unit of FIG. 3.
Figure 5:
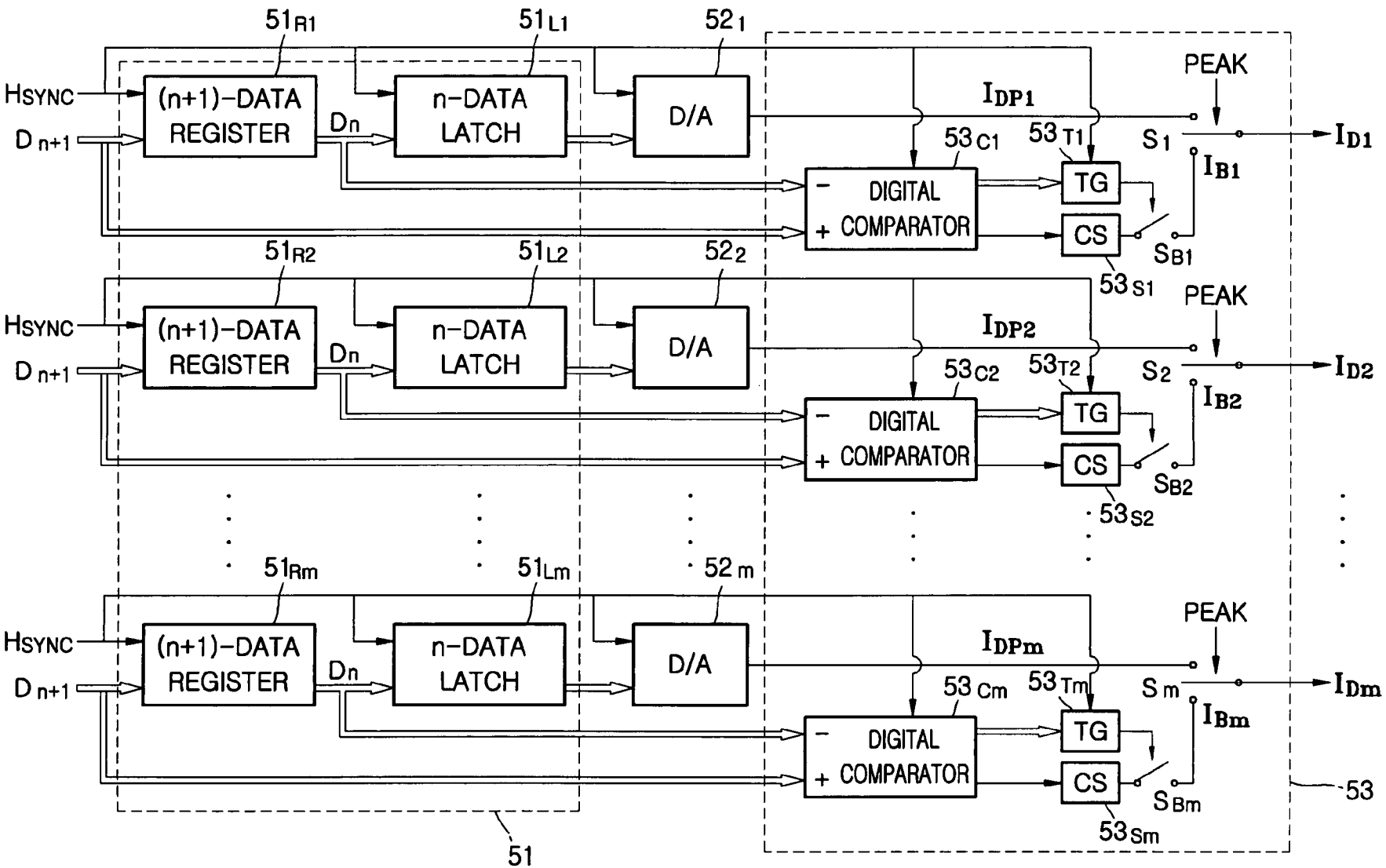
FIG. 5 is a detailed block diagram showing an interior configuration of the data driving unit of FIG. 2 according to the present invention.

Referring to FIGS. 1, 2, and 5, a latch circuit 51 of the data driving unit 5 of FIG. 2, according to the present invention, comprises (n+1)-data registers $\mathbf{51}_{R1}$-$\mathbf{51}_{Rm}$ and n-data latches $\mathbf{51}_{L1}$-$\mathbf{51}_{Lm}$. An output circuit 53 of the data driving unit according to the invention includes digital comparators $\mathbf{53}_{C1}$-$\mathbf{53}_{Cm}$, current sources $\mathbf{53}_{S1}$-$\mathbf{53}_{Sm}$, booting-current switches $S_{B1}$-$S_{Bm}$, timing signal generators $\mathbf{53}_{T1}$-$\mathbf{53}_{Tm}$, and output current switches $S_1$-$S_m$.

Each of the (n+1)-data registers $\mathbf{51}_{R1}$-$\mathbf{51}_{Rm}$ outputs a display data signal stored therein according to horizontal synchronization signal $H_{SYNC}$, and stores a display data signal $D_{n+1}$ received from the controller (21 of FIG. 1) through the interface (30 of FIG. 2). The n-data latches $\mathbf{51}_{L1}$-$\mathbf{51}_{Lm}$ output display data signals stored therein in response to horizontal synchronization signal $H_{SYNC}$, and store the display data signals $D_n$ received from the (n+1)-data registers $\mathbf{51}_{R1}$-$\mathbf{51}_{Rm}$, respectively. Digital-to-analog (D/A) converters $\mathbf{52}_1$-$\mathbf{52}_m$ then convert the display data signals $D_n$ in the current horizontal drive time period received from the n-data latches $\mathbf{51}_{L1}$-$\mathbf{51}_{Lm}$ into data current signals $I_{DP1}$ -$I_{DPm}$, respectively.

The digital comparators $\mathbf{53}_{C1}$-$\mathbf{53}_{Cm}$ of the output circuit 53 compare the display data signals $D_n$ in the current horizontal drive time period received from n-data latches $\mathbf{51}_{L1}$-$\mathbf{51}_{Lm}$ with the display data signals $D_{n+1}$ in the next horizontal drive time period received from (n+1)-data registers $\mathbf{51}_{R1}$-$\mathbf{51}_{Rm}$, respectively. The digital comparators $\mathbf{53}_{C1}$-$\mathbf{53}_{CM}$ generate signals indicating a magnitude change of the display data signals $D_{n+1}$ with respect to display data signals $D_n$ and generate signals indicating the amount of the change.

The current sources $\mathbf{53}_{S1}$-$\mathbf{53}_{Sm}$ output booting currents having constant instantaneous values and varying polarities depending on the magnitude change in the signals. Taking a data electrode line as an example, if the magnitude of display data signal $D_{n+1}$ in the next horizontal drive time period increases over that of display data signal $D_n$ in the current horizontal drive time period, a current source corresponding to the data electrode line outputs a positive polarity booting current during the next horizontal drive time period. Conversely, if the magnitude of display data signal $D_{n+1}$ in the next horizontal drive time period decreases over that of display data signal $D_n$ in the current horizontal drive time period, the current source corresponding to the data electrode line outputs a negative polarity booting current during the next horizontal drive time period. Since the booting currents are applied to the data electrode lines (3 of FIG. 1) at the beginning of each horizontal drive time period, it is possible to increase the speed at which the voltage is applied, i.e., driving speed for the EL cells (1 of FIG. 1), despite the presence of parasitic capacitance at the EL cells 1.

The booting-current switches $S_{B1}$-$S_{Bm}$ switch the booting currents $I_{B1}$-$I_{Bm}$ output from the current sources $\mathbf{53}_{S1}$-$\mathbf{53}_{Sm}$, respectively. The timing signal generators $\mathbf{53}_{T1}$-$\mathbf{53}_{Tm}$ control timing for operation of the booting-current switches $S_{B1}$-$S_{Bm}$ according to the signals indicating the amount of change received from the digital comparators $\mathbf{53}_{C1}$-$\mathbf{53}_{Cm}$. Specifically, the timing signal generators $\mathbf{53}_{T1}$-$\mathbf{53}_{Tm}$ allow the booting-current switches $S_{B1}$-$S_{Bm}$ to remain ON for a period proportional to the amount of magnitude change of display data signals at the beginning (t1~t3, t4~t6, t7~t9, t10~t12, t13~t15, or t16~t18 of FIG. 6) of each horizontal drive time period, respectively.

The power required for booting currents is adjusted by the amount of application time, which causes instantaneous values of the booting currents $I_{B1}$-$I_{Bm}$ to be kept constant. Thus, it is possible to limit excessive increases in the instantaneous values of the booting currents $I_{B1}$-$I_{Bm}$, which prevents occurrences of crosstalk, that is, unscanned EL cells emitting light, while reducing power consumption.

The output current switches $S_1$-$S_m$ apply data output signals $I_{D1}$-$I_{Dm}$ to the data electrode lines 3, respectively. The data output signals $I_{D1}$-$I_{Dm}$ are generated by alternately selecting from the output signals $I_{B1}$-$I_{Bm}$ of the booting-current switches $S_{B1}$-$S_{Bm}$ and the output signals $I_{DP1}$-$I_{DPm}$ of the D/A converters $\mathbf{52}_1$-$\mathbf{52}_m$, respectively.

Figure 6:
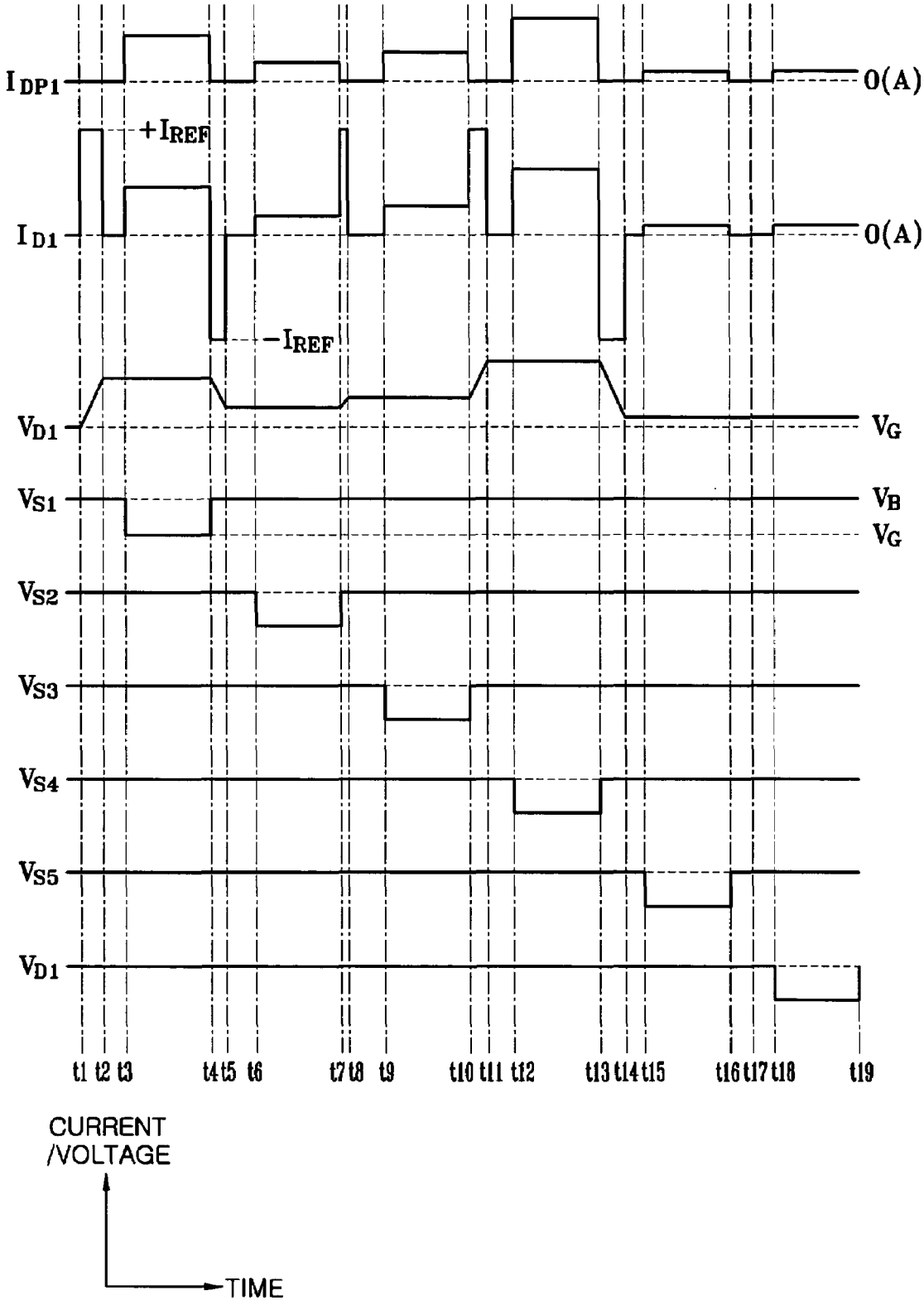
FIG. 6 is a timing diagram for explaining a method for driving an EL display device having the data driving unit of FIG. 5 according to the present invention.

A method for driving an EL display device having the data driving unit of FIG. 5 according to the present invention, will now be described with reference to FIGS. 5 and 6. In FIG. 6, reference character $I_{DP1}$ is a data current signal from a D/A converter $\mathbf{52}_1$, $I_{D1}$ is a data output signal applied to the data electrode line (3*a* of FIG. 1) from the output current switch $S_1$ corresponding to the D/A converter $\mathbf{52}_1$, $V_{D1}$ is a data voltage signal applied to the data electrode line 3*a*, and $V_{S1}$-$V_{S6}$ are scanning voltage signals applied to the scanning electrode lines (4 of FIG. 1).

With reference to the data output signal $I_{D1}$, a booting current, corresponding to a magnitude change of a display data signal $D_{n+1}$ in the next horizontal drive time period with respect to a display data signal $D_n$ in the current horizontal drive time period, is applied to the data electrode line 3*a* at the beginning t1~t3, t4~t6, t7~t9, t10~t12, t13~t15 or t16~t18 of the next horizontal drive time period. This makes it possible to increase speed in which the of voltage is applied, i.e., a driving speed for the EL cells (1 of FIG. 1), despite the presence of parasitic capacitance at the EL cells 1.

While an instantaneous value $I_{REF}$ of booting current is kept constant, the amount of application time t1~t2, t4~t5, t7~t8, t10~t11, t13~t14 or t16~t17 for the booting current is proportional to the amount of magnitude change of the data current signal $I_{DP1}$. Thus, the power required for booting current $I_{B1}$ is adjusted by the amount of application time to keep an instantaneous value of the booting current $I_{B1}$ constant. It is possible to limit excessive increases in the instantaneous value of the booting current $I_{B1}$, which prevents occurrences of crosstalk, that is, unscanned EL cells emitting light, while reducing power consumption. In connection therewith, first and second drive periods t1~t3 and t4~t7 will now be representatively described.

The magnitude of the data current signal $I_{DP1}$ during scanning time interval t3~t4 increases over that of the data current signal $I_{DP1}$ during the previous scanning time interval (not shown) at the beginning t1-t3 of the first horizontal drive period t1~t4. An instantaneous value $+I_{REF}$ of positive polarity booting current is applied to the data electrode line 3*a*. Here, the application time interval t1~t2 is proportional to the amount by which the magnitude of the data current signal $I_{DP1}$ at the scanning time interval t3~t4 increases from previous scanning time interval.

Conversely, the magnitude of the data current signal $I_{DP1}$ during scanning time interval t6~t7 decreases over that of the data current signal $I_{DP1}$ during the previous scanning time interval t3~t4 at the beginning of the second horizontal drive period t4~t7. An instantaneous value $-I_{REF}$ of negative polarity booting current is applied to the data electrode line 3*a*. Here, the application time interval t4-t5 is proportional to the amount by which the magnitude of the data current signal $I_{DP1}$ during the scanning time interval t6~t7 decreases from the previous scanning time interval t3~t4.

As described above, the method and apparatus for driving an EL display panel according to the present invention make it possible to keep instantaneous values of booting currents constant by adjusting the power required for the booting currents, depending on the amount of application time. Since it is possible to limit excessive increases in instantaneous values of booting currents, this invention may prevent occurrences of crosstalk, that is, when unscanned EL cells emit light, while reducing power consumption.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method for driving an electro-luminescence display panel having electro-luminescence cells and data electrode lines and scanning electrode lines intersecting each other at a predetermined distance, each of the electro-luminescence cells being formed at the intersections thereof, comprising the step of:

applying a booting current to each of the data electrode lines at the beginning of the next horizontal drive time period, wherein the booting current:

corresponds to a magnitude change of a display data signal in the next horizontal drive time period with respect to a display data signal in the current horizontal drive time period;

has instantaneous values which are kept constant; and has an application time amount that for the booting current is proportional to a magnitude change of each display data signal in the next horizontal drive time period with respect to the display data signal in the current horizontal drive time period.

2. The method of claim 1, wherein the booting current is applied in a forward direction with respect to the EL cells when the magnitude of the display data signal in the next horizontal drive time period is larger than that of the display data signal in the current horizontal drive time period, and wherein the booting current is applied in a reverse direction with respect to the EL cells, when the magnitude of the display data signal in the next horizontal drive time period is smaller than that of the display data signal in the current horizontal drive time period.

3. The method of claim 2, wherein no booting current is applied when the magnitudes of the display data signals in the current and next horizontal drive time periods are equal to each other.

4. An apparatus for driving an electro-luminescence display panel, comprising:

data electrode lines and scanning electrode lines intersecting each other at predetermined distances; and a plurality of electro-luminescence cells, each of the plurality of electro-luminescence cells being formed at the intersections thereof, wherein:

a booting current is applied to each of the data electrode lines at the beginning of the next horizontal drive time period;

the booting current corresponds to a magnitude change of a display data signal in the next horizontal drive time period with respect to a display data signal in the current horizontal drive time period;

instantaneous values of the booting currents are kept constant; and the application time for the booting current is proportional to a magnitude change of each display data signal in the next horizontal drive time period with respect to the display data signal in the current horizontal drive time period.

5. The apparatus of claim 4, comprising:

a data driving unit connected to signal-input terminals of the data electrode lines for producing data current signals, corresponding to display data signals, in response to input switching control signals in order to apply the data current signals to the data electrode lines, respectively, and applying the booting currents to the data electrode lines at the beginning of each horizontal drive time period, respectively;

a scanning driving unit connected to signal-input terminals of the scanning electrode lines for sequentially applying scanning driving signals in response to input switching control signals to the scanning electrode lines, respectively; and a controller that inputs the display data signals and the switching control signals to the data driving unit and inputs the switching control signals to the scanning driving unit, respectively.

6. The apparatus of claim 5, wherein the data driving unit comprises:

a latch circuit that periodically stores the display data signals received from the controller and periodically outputs display data signals in the current and next horizontal drive time periods;

a plurality of digital-to-analog converters that convert the display data signals in the current horizontal drive time period received from the latch circuit into data current signals, respectively; and an output circuit that compares the display data signals in the current and next horizontal drive time periods received from the latch circuit with each other, applies the booting currents to the data electrode lines, respectively, and applies the data current signals received from the plurality of digital-to-analog converters to the data electrode lines, respectively.

7. The apparatus of claim 6, wherein the latch circuit comprises:

a plurality of (n+1)-data registers that output display data signals stored therein according to a horizontal synchronization signal and store the display data signals received from the controller; and a plurality of n-data latches that output display data signals stored therein in response to the horizontal synchronization signal and store the display data signals received from the plurality of (n+1)-data registers, respectively.

8. The apparatus of claim 6, wherein the output circuit comprises:

a plurality of digital comparators that compare the display data signals in the current and next horizontal drive time periods received from the latch circuit with each other, and generate signals indicating a magnitude difference between the display data signals in the current and next horizontal drive time periods and signals corresponding to the magnitude difference;

a plurality of current sources that output booting currents having constant instantaneous values and varying polarities depending on the signals indicating the magnitude change;

a plurality of booting-current switches that switch booting currents output from the plurality of current sources, respectively;

a plurality of timing signal generators that control timing for operation of the plurality of booting-current switches according to the signals indicating the amount of change received from the plurality of digital comparators, respectively; and a plurality of output current switches that alternately select the output signals of the plurality of booting-current switches or output signals of the plurality of digital-to-analog converters and apply the selected signals to the data electrode lines, respectively.

* * * * *